US012031295B2

(12) United States Patent
Usami et al.

(10) Patent No.: US 12,031,295 B2
(45) Date of Patent: Jul. 9, 2024

(54) WORK VEHICLE

(71) Applicant: Kubota Corporation, Osaka (JP)

(72) Inventors: Takahiro Usami, Sakai (JP); Kosuke Hattori, Sakai (JP); Yoshihiro Ebata, Sakai (JP); Shinsuke Hisatake, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 211 days.

(21) Appl. No.: 17/834,935

(22) Filed: Jun. 8, 2022

(65) Prior Publication Data

US 2023/0042733 A1 Feb. 9, 2023

(30) Foreign Application Priority Data

Aug. 5, 2021 (JP) ..... 2021-129067

(51) Int. Cl.
*E02F 9/08* (2006.01)
*E02F 9/16* (2006.01)

(52) U.S. Cl.
CPC ..... *E02F 9/0866* (2013.01); *E02F 9/0891* (2013.01); *E02F 9/163* (2013.01)

(58) Field of Classification Search
CPC ..... E02F 9/0866; E02F 9/0891; E02F 9/163
See application file for complete search history.

(56) References Cited

U.S. PATENT DOCUMENTS

| | | | | |
|---|---|---|---|---|
| 4,962,825 | A | 10/1990 | Albright et al. | |
| 6,092,616 | A | 7/2000 | Burris et al. | |
| 8,893,834 | B2 * | 11/2014 | Berkeland | E02F 9/0891 296/100.09 |
| 8,919,486 | B2 * | 12/2014 | Nakagami | F01N 13/08 180/309 |
| 9,523,182 | B2 * | 12/2016 | Yabe | E02F 9/0883 |
| 10,556,500 | B2 * | 2/2020 | Mizuno | B60K 13/04 |
| 2013/0074410 | A1 * | 3/2013 | Berkeland | E02F 9/0866 49/142 |

(Continued)

FOREIGN PATENT DOCUMENTS

| | | |
|---|---|---|
| JP | 08-072562 | 3/1996 |
| JP | 4143704 B2 | 1/2001 |

(Continued)

*Primary Examiner* — Jacob B Meyer
(74) *Attorney, Agent, or Firm* — MORI & WARD, LLP

(57) ABSTRACT

A work vehicle includes a cover having a center cover portion, a first side cover portion, and a second side cover portion. The center cover portion includes a punching metal and has a substantially rectangular shape. A first side and a second side of the rectangular shape face each other in a width direction, and a third side and a fourth side of the rectangular shape face each other in a front-rear direction. The first side cover includes a punching metal, has a substantially rectangular shape, is connected to the center cover portion at the first side, and is inclined downward in the height direction relative to the center cover portion. The second side cover includes a punching metal, has a substantially rectangular shape, is connected to the center cover portion at the second side, and is inclined downward in the height direction relative to the center cover portion.

20 Claims, 12 Drawing Sheets

(56) References Cited

U.S. PATENT DOCUMENTS

| | | | | |
|---|---|---|---|---|
| 2014/0238767 | A1* | 8/2014 | Numa | B60K 11/04 180/309 |
| 2016/0090712 | A1 | 3/2016 | Yamashita et al. | |
| 2016/0265193 | A1* | 9/2016 | Ohmura | F01N 3/021 |
| 2016/0265194 | A1* | 9/2016 | Ohmura | F01N 3/021 |
| 2016/0356017 | A1* | 12/2016 | Ueda | E02F 9/0866 |
| 2018/0162216 | A1* | 6/2018 | Mizuno | E02F 9/0866 |
| 2022/0205218 | A1* | 6/2022 | Kim | B62D 25/12 |
| 2023/0042733 | A1* | 2/2023 | Usami | E02F 9/0866 |

FOREIGN PATENT DOCUMENTS

| | | | | | |
|---|---|---|---|---|---|
| JP | 2001001752 | A | * | 1/2001 | |
| JP | 4143704 | B2 | * | 9/2008 | |
| JP | 5385707 | B2 | | 1/2011 | |
| JP | 6286338 | B2 | | 5/2016 | |
| JP | 6400520 | B2 | | 11/2016 | |
| JP | 6574403 | B2 | | 2/2017 | |
| JP | 6679676 | B2 | | 12/2018 | |
| JP | 2020-007907 | | | 1/2020 | |
| JP | 2020-122291 | | | 8/2020 | |
| WO | WO-2014192404 | A1 | * | 12/2014 | B60K 11/02 |
| WO | WO-2015141530 | A1 | * | 9/2015 | B60K 11/02 |
| WO | WO-2016024641 | A1 | * | 2/2016 | B60K 11/04 |
| WO | WO-2017203588 | A1 | * | 11/2017 | B60K 11/04 |

* cited by examiner

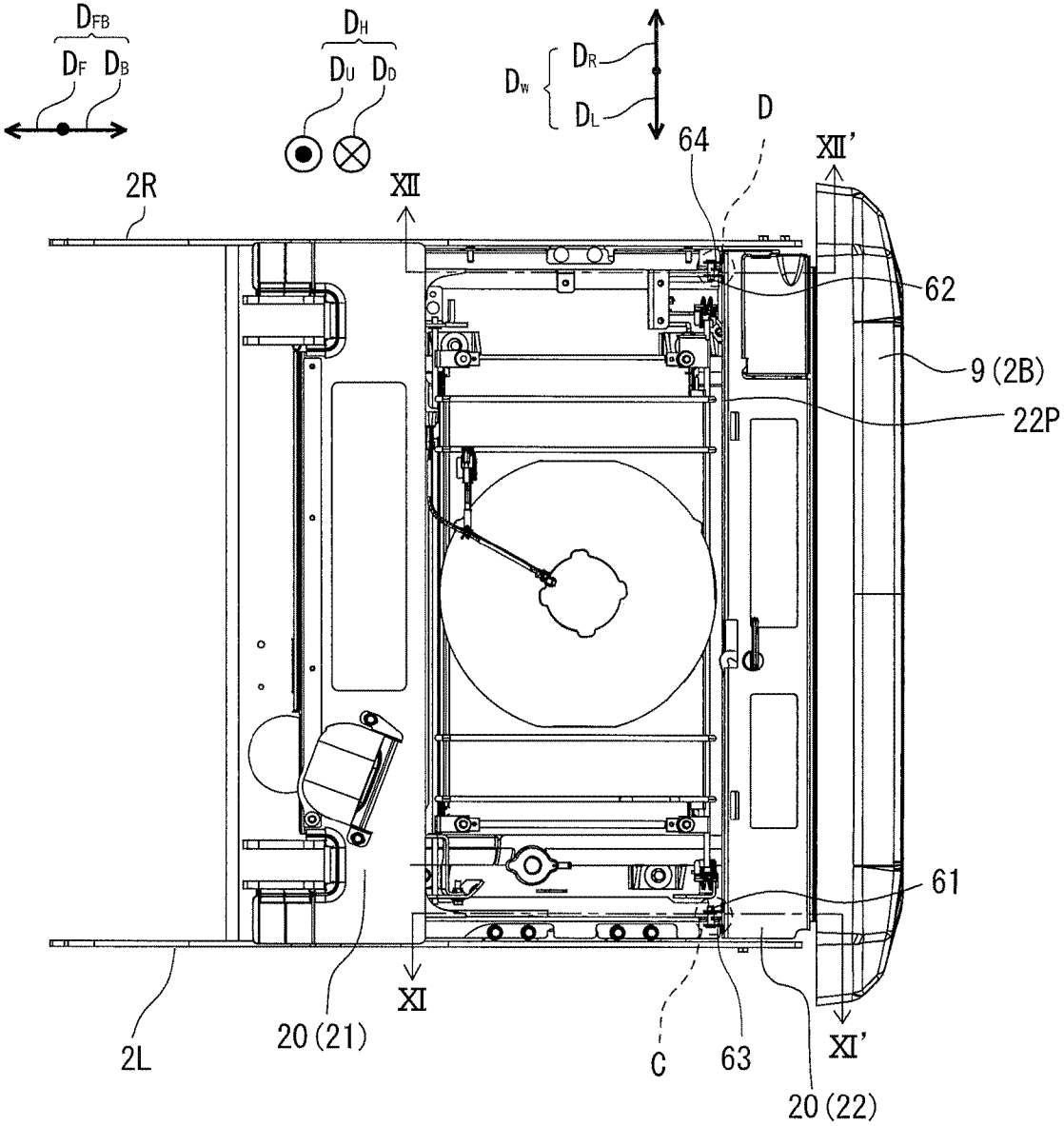
FIG. 10
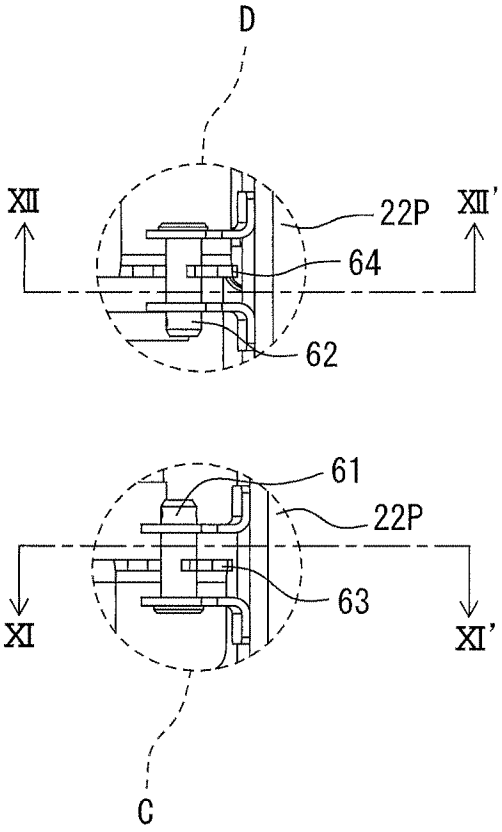

WORK VEHICLE

The present application claims priority under 35 U. S. C. § 119 to Japanese Patent Application No. 2021-129067, filed Aug. 5, 2021. The contents of this application are incorporated herein by reference in their entirety.

BACKGROUND OF THE INVENTION

Field of the Invention

The present invention relates to a work vehicle.

Discussion of the Background

Japanese Patent No. 5385707 discloses an exhaust mechanism provided with a cover having a ventilation hole inclined rearward or forward.

SUMMARY OF THE INVENTION

According to a first aspect of the present disclosure, a work vehicle includes a cabin, a vehicle body frame, a first traveling device, a second traveling device, and a cover. The cabin has a seat. The vehicle body frame supports the cabin. The vehicle body frame includes a first side surface, a second side surface opposite to the first side surface in a width direction, and a third side surface connecting the first side surface and the second side surface and facing the cabin in a front-rear direction perpendicular to the width direction. The first traveling device is provided on the first side surface of the vehicle body frame. The second traveling device is provided on the second side surface of the vehicle body frame. The cover is provided above the first side surface, the second side surface, and the third side surface in a height direction perpendicular to the width direction and the front-rear direction. Air passes through the cover to and from a space surrounded by the first side surface, the second side surface, the third side surface, and the cabin. The cover includes a center cover portion, a first side cover portion, and a second side cover portion. The center cover portion includes a perforated metal. The center cover portion has a substantially rectangular shape. A first side and a second side of the rectangular shape face each other in the width direction, and a third side and a fourth side of the rectangular shape face each other in the front-rear direction. The first side cover portion includes a perforated metal. The first side cover portion has a substantially rectangular shape, is connected to the center cover portion at the first side, and is inclined downward in the height direction with respect to the center cover portion. The second side cover portion includes the perforated metal. The second side cover portion has a substantially rectangular shape, is connected to the center cover portion at the second side, and is inclined downward in the height direction with respect to the center cover portion.

According to a second aspect of the present disclosure, a work vehicle includes a cabin, a vehicle body frame, a first traveling device, a second traveling device, and a cover. The cabin has a seat. The vehicle body frame supports the cabin. The vehicle body frame includes a first side surface, a second side surface facing the first side surface in a width direction, a third side surface connecting the first side surface and the second side surface and facing a cabin in a front-rear direction perpendicular to the width direction, and an upper surface having an opening and connecting an upper end of the first side surface, an upper end of the second side surface and an upper end of the third side surface. The first traveling device is provided on the first side surface of the vehicle body frame. The second traveling device is provided on the second side surface of the vehicle body frame. The cover is provided so as to cover the opening. Air passes through the cover to and from a space surrounded by the first side surface, the second side surface, the third side surface, the upper surface, and the cabin. The upper surface includes a proximal end upper frame and a distal end upper frame. The proximal end upper frame is provided between the cabin and the cover in a front-rear direction. The distal end upper frame is provided opposite to the proximal end upper frame with respect to the cover in the front-rear direction. The proximal end upper frame includes an insertion opening passing through the proximal end upper frame in the front-rear direction. The distal end upper frame includes a spring plate for pressing the cover toward the proximal end upper frame. The cover includes a first cover side surface, a second cover side surface, and a locking claw. The first cover side surface faces the proximal end upper frame. The second cover side surface faces the distal end upper frame to contact with the spring plate. The locking claw is provided on the first cover side surface and is configured to be inserted into the insertion opening.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings.

FIG. 10 is an enlarged view of an upper surface of a rear portion of the work vehicle when the cover and the additional cover are removed.

DESCRIPTION OF THE EMBODIMENTS

Figure 1:
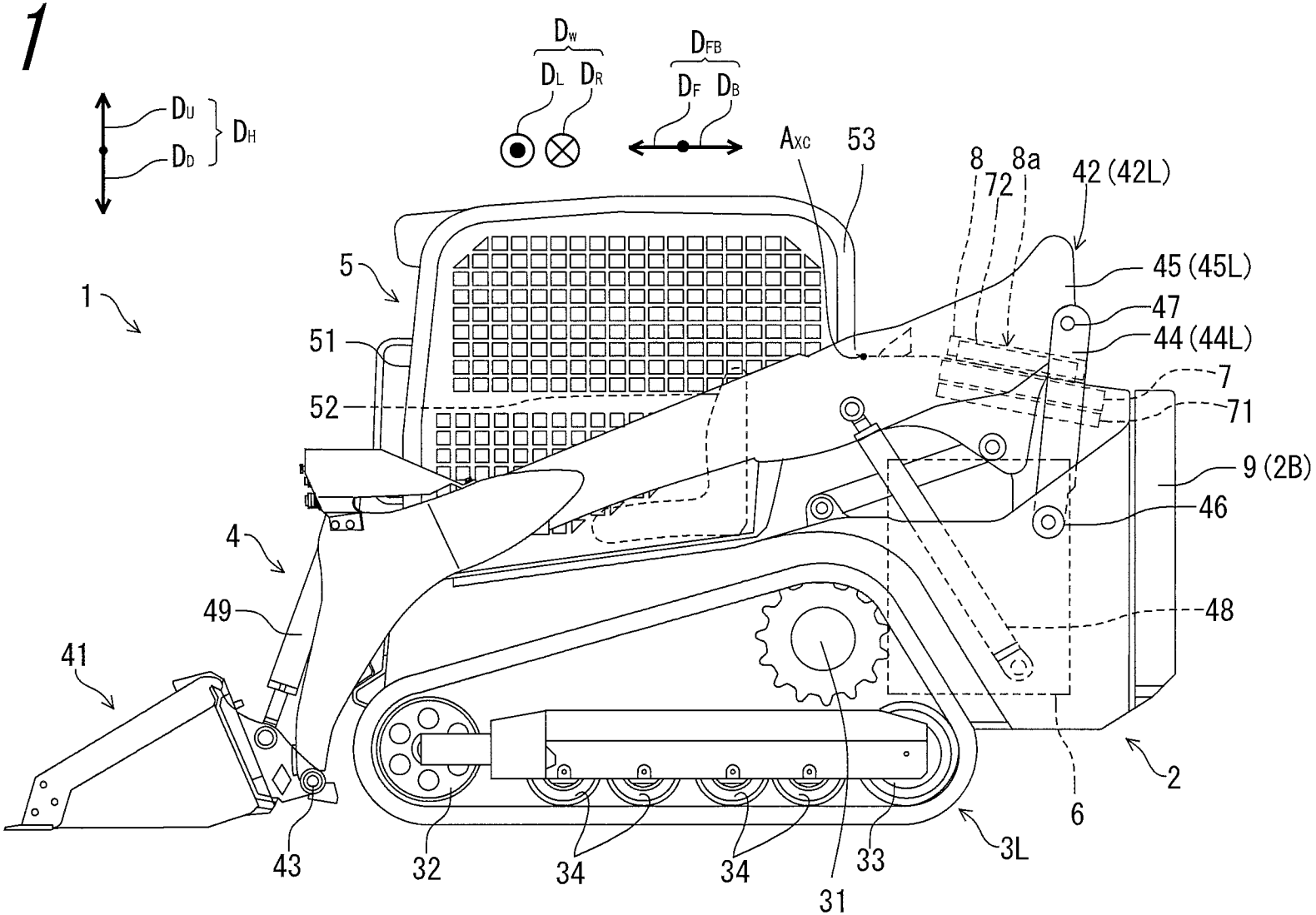
FIG. 1 is a side view of the work vehicle.

Hereinafter, the present invention will be described in detail with reference to drawings showing embodiments thereof. In the drawings, the same reference numerals indicate corresponding or substantially identical configurations.

EMBODIMENTS

Overall Configuration

Figure 2:
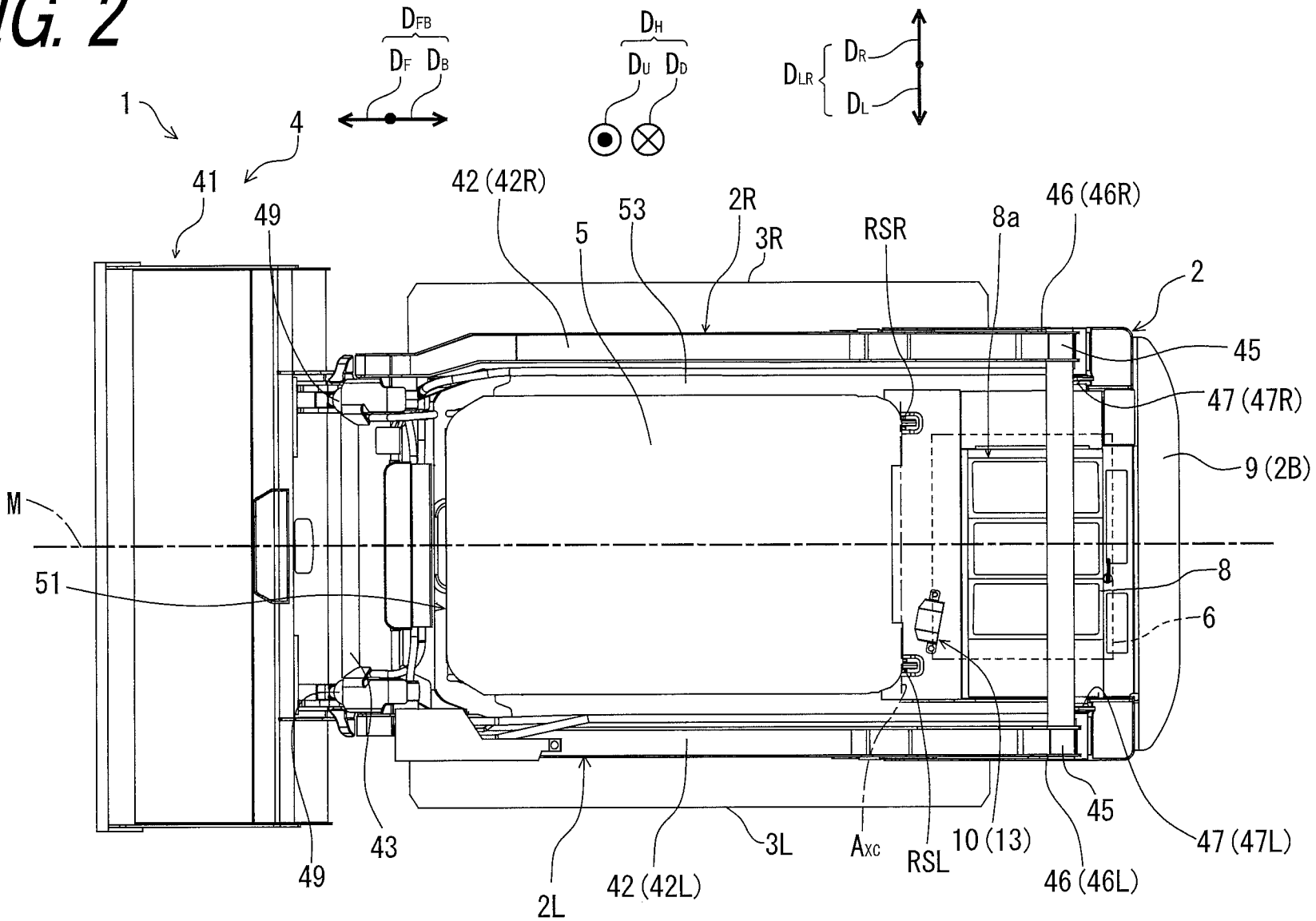
FIG. 2 is a top view of the work vehicle.
Figure 3:
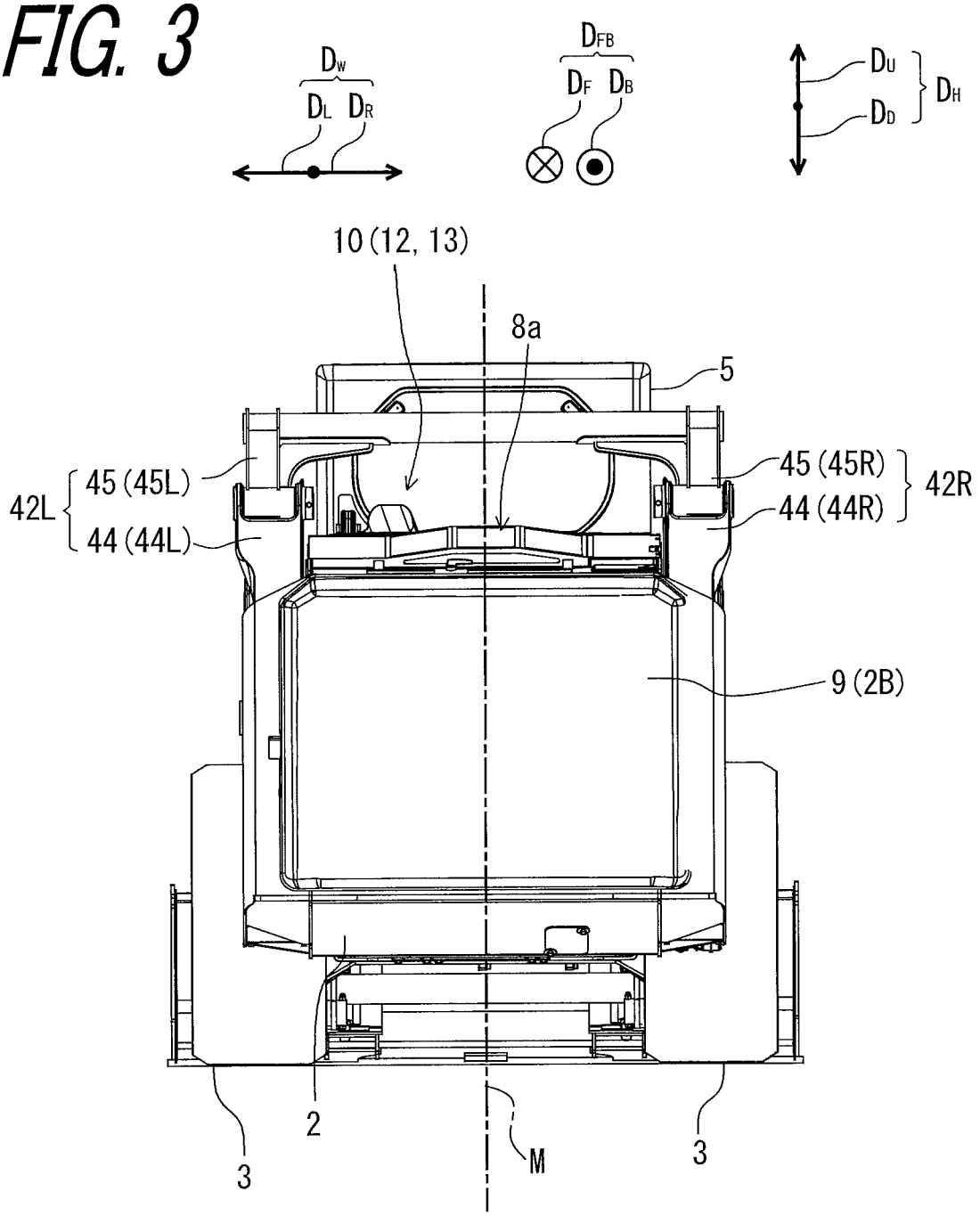
FIG. 3 is a rear view of the work vehicle.

Referring to FIGS. 1 to 3, the work vehicle 1, for example, a compact truck loader, includes the vehicle body frame 2, the first traveling device 3L, the second traveling device 3R, a working device 4, and the cabin 5. The vehicle body frame 2 supports the first traveling device 3L, the second traveling device 3R, the working device 4, and the cabin 5. In the illustrated embodiment, the first traveling device 3L and the second traveling device 3R are crawler type traveling devices. Therefore, the first traveling device 3L and the second traveling device 3R include drive wheels 31, driven wheels 32 and 33, and rolling wheels 34, respectively. However, the first traveling device 3L and the second traveling device 3R are not limited to the crawler type traveling device. The first traveling device 3L and the second traveling device 3R may be, for example, a front wheel/rear wheel traveling device or a traveling device having a front wheel and a rear crawler. As shown in FIG. 2, the first traveling device 3L is provided on the first side surface 2L of the vehicle body frame 2. The second traveling device 3R is provided on the second side surface 2R of the vehicle body frame 2. The working device 4 includes work implement (bucket) 41 at the distal end of working device 4. A proximal end of the working device 4 is attached to a rear portion of the vehicle body frame 2. The working device 4 includes a pair of arms 42 for rotatably supporting the bucket 41 via the bucket pivot shaft 43. Each of the pair of arms 42 includes a lift link 44 and boom 45.

The lift link 44 is rotatable with respect to the vehicle body frame 2 around a fulcrum shaft 46. The boom 45 is rotatable with respect to the lift link 44 around a joint shaft 47. The working device 4 further includes a plurality of boom cylinders 48 and at least one equipment cylinder 49. Each of the plurality of boom cylinders 48 is rotatably connected to the vehicle body frame 2 and the boom 45, and moves the lift link 44 and the boom 45 to move up and down the bucket 41. At least one instrument cylinder 49 is configured to tilt the bucket 41. The cabin 5 is attached to a front portion of the vehicle body frame 2. The work vehicle 1 is provided with a front door 51 in front of the cabin 5, and the driver's seat 52 and an operating device (not illustrated) are provided in the cabin 5. An internal space of the cabin 5 is defined by a cab frame 53. As shown in FIG. 2, the cab frame 53 is rotatable about rotational shafts RSL and RSR on the vehicle body frame 2. In FIGS. 1 and 2, a common rotational axis AXC as defined by rotational axes RSL and RSR is illustrated.

In the embodiment according to the present the embodiment, a front-rear direction $D_{FB}$ (forward $D_F$/rearward $D_B$) means a front-rear direction (front/rear direction) as seen from an operator seated on the driver's seat 52 of the cabin 5. A left direction $D_L$, a right direction $D_R$, a width direction $D_W$ mean a left direction, a right direction, and a left/right direction respectively, as viewed from the operator. An up direction $D_U$, a down direction $D_D$; a height direction $D_H$. mean an upward direction, a downward direction and a height direction as viewed from the operator. Front/rear, left/right (width), up/down (height) directions of the work vehicle 1 correspond to the front/rear, left/right (width), up/down (height) directions as viewed from the operator respectively.

In FIG. 1, one of the pair of arms 42 is provided on the left side of the cabin 5. The other of the pair of arms 42 is provided on the right side of the cabin 5. More specifically, one of the boom cylinders 48 and one of the boom 45 are provided on the left side of the cabin 5. The other boom cylinder 48 and the other boom 45 are provided on the right side of the cabin 5. FIG. 1 shows the left side of the work vehicle 1. As shown in FIGS. 2 and 3, the vehicle body frame 2 is substantially symmetrical with respect to the vehicle body center plane M, and the first side surface 2L and the second side surface 2R are provided so as to face each other in the width direction $D_W$. Among the pair of arms 42, an arm 42 provided on the left side with respect to the vehicle body center plane M is shown as a first arm 42L, and an arm 42 provided on the right side with respect to the vehicle body center plane M is shown as a second arm 42R. The lift link 44 provided on the left side with respect to the vehicle body center plane M is shown as a first lift link 44L, and the lift link 44 provided on the right side with respect to the vehicle body center plane M is shown as a second lift link 44R. A boom 45 provided on the left side with respect to the vehicle body center plane M is shown as a first boom 45L, and a boom 45 provided on the right side with respect to the vehicle body center plane M is shown as a second boom 45R. A fulcrum shaft 46 provided on the left side of the vehicle body with respect to the vehicle body center plane M is shown as a first fulcrum shaft 46L, a fulcrum shaft 46 provided on the right side of the vehicle body center plane M is shown as the second fulcrum shaft 46R. A joint shaft 47 provided on the left side with respect to the vehicle body center plane M is shown as a first joint shaft 47L, and a joint shaft 47 provided on the right side with respect to the vehicle body center plane M is shown as a second joint shaft 47R.

Referring to FIG. 1, the work vehicle 1 further includes an engine 6 and the heat exchanger 7 provided at a rear portion of the vehicle body frame 2. The engine 6 is configured to provide driving force to the first traveling device 3L, the second traveling device 3R, and the working device 4. The heat exchanger 7 includes a radiator for cooling the refrigerant of the engine 6. Further, preferably, the heat exchanger 7 includes an oil cooler configured to cool hydraulic fluid used in the hydraulic system of the work vehicle 1 (e.g., boom cylinder 48 and at least one instrument cylinder 49). The work vehicle 1 includes a fan 71 for air-cooling the heat exchanger 7. The fan 71 is provided in the down direction $D_D$ and height direction $D_H$ with respect to the heat exchanger 7. The engine 6 and the heat exchanger 7 are provided between a pair of arms 42 in the width direction $D_W$ of the work vehicle 1.

The work vehicle 1 further includes a bonnet cover 9 provided at the rear end of the vehicle body frame 2. The bonnet cover 9 can be opened and closed and thus a maintenance worker can perform maintenance work on the engine 6 and the like. The bonnet cover 9 can be regarded as a part of the vehicle body frame 2. That is, the third side surface 2B of the cabin 5 facing the cabin 5 in the front-rear direction $D_{FB}$ perpendicular to the width direction $D_W$ can be viewed as being constituted by the openable and closable bonnet cover 9.

Referring to FIG. 2, the vehicle body frame 2 has the first side surface 2L, second side face 2R opposite to the first side surface 2L in the width direction $D_W$, and the third side surface 2B connecting the first side surface 2L and the second side face 2R.

Referring to FIGS. 1 to 3, the work vehicle 1 further includes the cover 8 for taking air in and out of a space surrounded by the first side surface 2L, the second side surface 2R, the third side surface 2B, and the cabin 5. The cover 8 is provided above the first side surface 2L, the second side surface 2R, and the third side surface 2B in the height direction $D_H$ perpendicular to the width direction $D_W$ and the front-rear direction $D_{FB}$. The cover 8 is provided in the rear $D_B$ of the cabin 5 in the front-rear $D_{FB}$ direction. The cover 8 covers the heat exchanger 7. The cover 8 further covers the engine 6. The cover 8 is provided with an air suction port 8*a* for taking air into the inside of the cover 8. The work vehicle 1 is provided between the cover 8 and the heat exchanger 7 in the height direction $D_H$ and includes an additional fan 72 configured to blow away the dust accumulated on the cover 8 and blocking the air suction port 8*a*.

Figure 4:
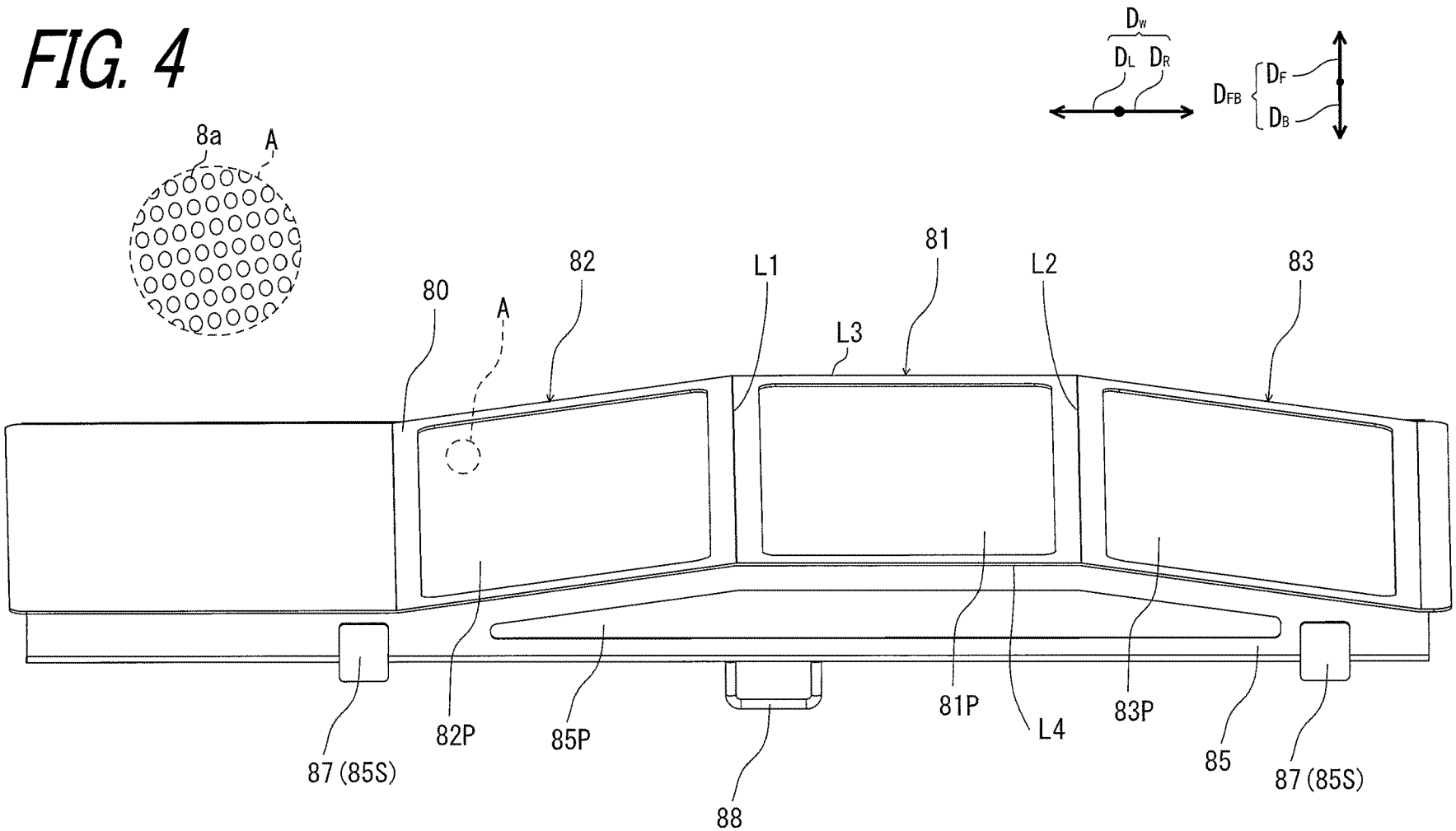
FIG. 4 is a perspective view of the cover as viewed from one direction.
Figure 5:
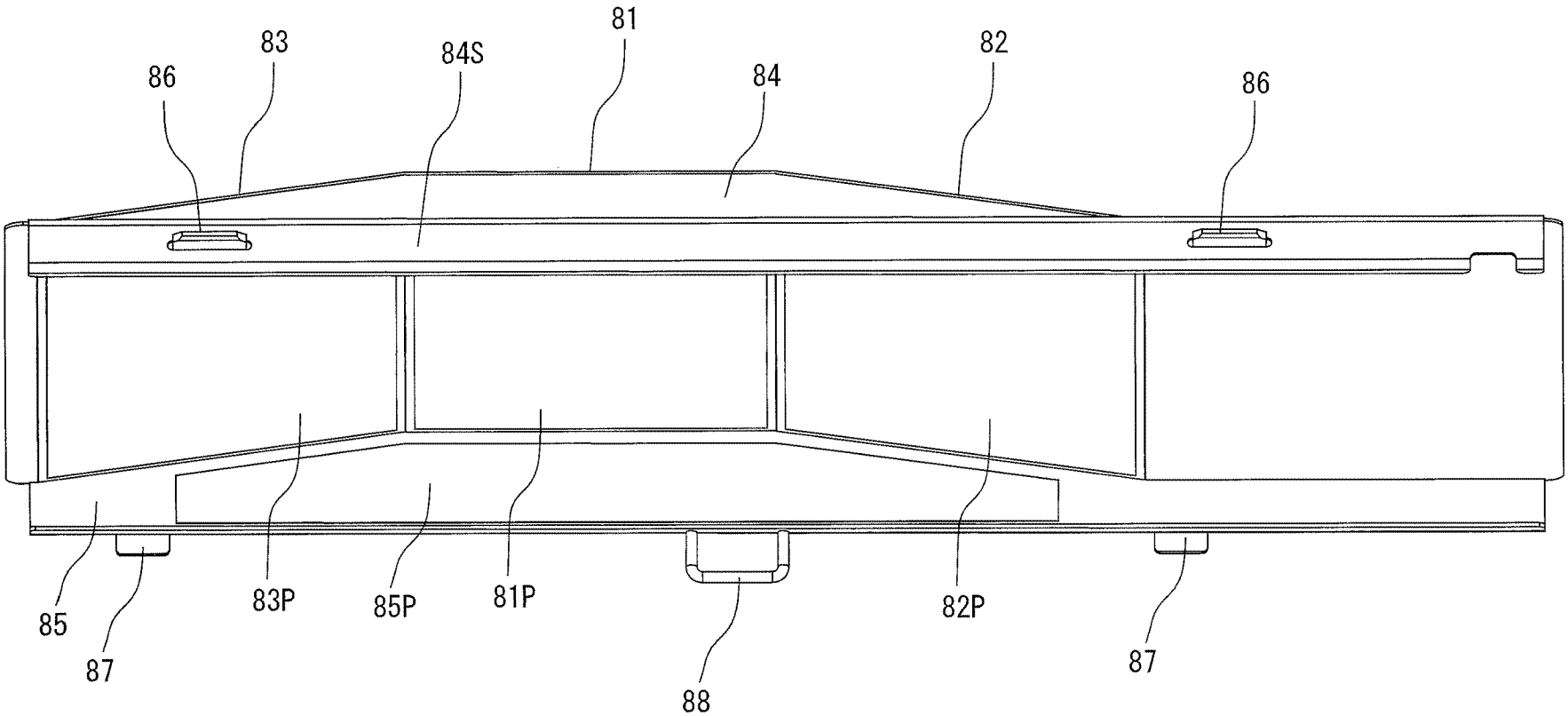
FIG. 5 is a perspective view of the cover as viewed from another direction.

FIG. 4 is a perspective view of the cover 8 as viewed from one direction. FIG. 5 is a perspective view of the cover 8 as viewed from another direction. FIG. 4 is a perspective view of the cover 8 when the cover 8 is attached to the work vehicle 1 as viewed forward and downward. FIG. 5 is a perspective view of the cover 8 when the cover 8 is attached to the work vehicle 1 as viewed rearward and upward. Referring to FIGS. 4 and 5, the cover 8 includes a center cover portion 81, the first side cover portion 82, and a second side cover portion 83. The center cover portion 81 includes a substantially flat perforated metal 81P having a substantially rectangular shape, wherein the first side of the rectangle L1 and he second side L2 is opposite to each other in the width direction $D_W$, and the third side L3 and the fourth side L4 are opposite to each other in the front-rear direction $D_{FB}$. The first side cover portion 82 includes a perforated metal 82P which is substantially flat, has a substantially rectangular shape, is connected to the center cover portion 81 at the first side L1, and is inclined downward $D_D$ in the height direction $D_H$ with respect to the center cover portion 81. The second side cover portion 83 includes a substantially flat perforated metal 83P, has a substantially rectangular shape, is connected to the center cover portion 81 at the second side L2 of the rectangle, and is inclined downward $D_D$ in the height direction $D_H$ with respect to the center cover portion 81.

The cover 8 further includes a reinforcing member (stiffener) 80 which surrounds a periphery of the perforated metal 81P of the center cover portion 81, a periphery of the perforated metal 82P of the first side cover portion 82, and a periphery of the perforated metal 83P of the second side cover portion 83, and is thicker than the perforated metals (81P, 82P, 83P). As shown in the enlarged area A in FIG. 4, the perforated metals 81P, 82P, 83P are provided with air suction ports 8*a* in a lattice shape or a zigzag shape. The air suction port 8*a* may be formed as a polygonal hole.

Figure 6:
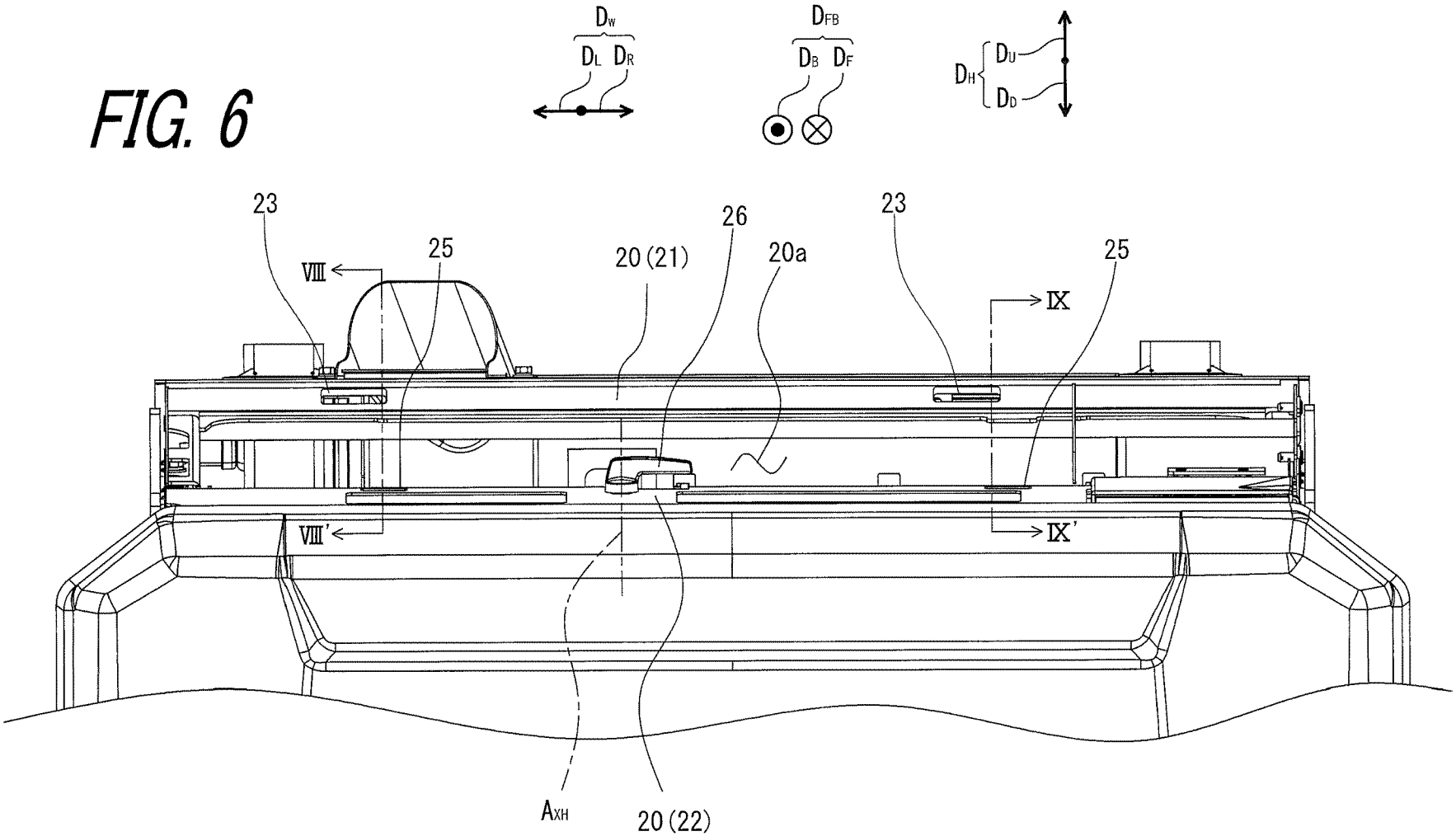
FIG. 6 is an enlarged back view of the rear portion of the work vehicle when the cover is removed.
Figure 7:
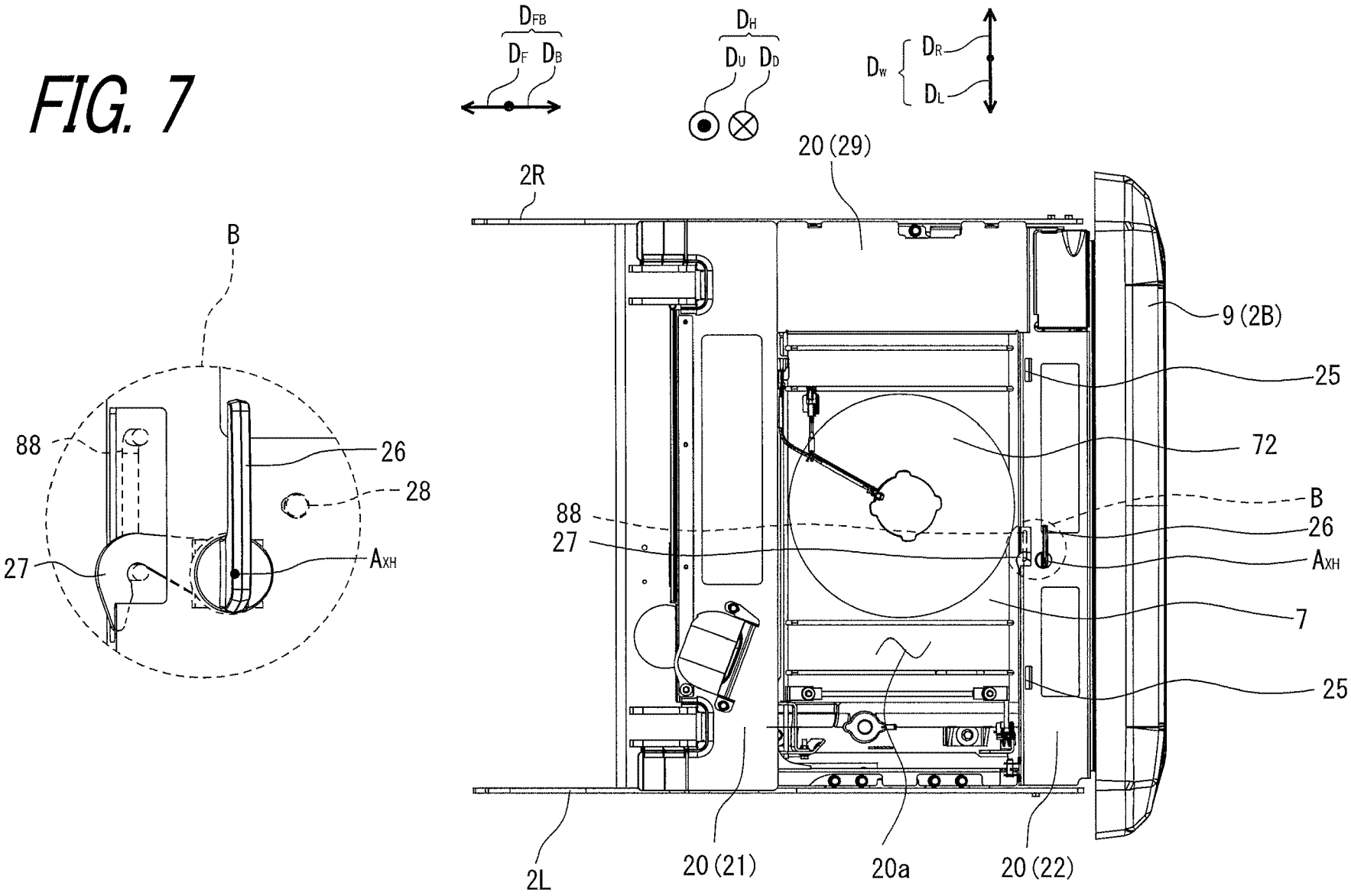
FIG. 7 is an enlarged view of an upper surface of a rear portion of the work vehicle when the cover is removed.

FIG. 6 is an enlarged view of the rear surface of the work vehicle 1 when the cover 8 is removed. FIG. 7 is an enlarged view of the upper surface of the rear portion of the work vehicle 1 when the cover 8 is removed. In FIG. 6, in order to improve the visibility, the heat exchanger 7, the additional fan 72, and the additional cover 29 described later are not illustrated. The vehicle body frame 2 is connected to the upper end of the first side surface 2L, the upper end of the second side surface 2R, and the upper end of the third side surface 2B, and further includes an upper surface 20 having an opening 20*a*. As shown in FIG. 2, the cover 8 is provided so as to cover the opening 20*a*. Referring to FIG. 7, the heat exchanger 7 is provided so as to overlap with the opening 20*a* when viewed from the height direction $D_H$. The fan 71 is configured to take in outside air from the cover 8 and the opening 20*a*. The upper surface 20 includes the proximal end upper frame 21 and the distal end upper frame 22. The proximal end upper frame 21 is provided between the cabin 5 and the cover 8 in the front-rear direction $D_{FB}$. The distal end upper frame 22 is provided on the opposite side of the proximal end upper frame 21 with respect to the cover 8 in the front-rear direction $D_{FB}$.

Referring to FIGS. 4 and 5, the cover 8 further includes the center cover portion 81, a first side cover portion 82, a second side cover portion 83, and a trapezoidal third side cover portion 84 and a fourth side cover portion 85 which are opposite to each other in the front-rear direction $D_{FB}$. In the front-rear direction $D_{FB}$, the third side cover portion 84 is provided closer to the cabin 5 than the fourth side cover portion 85. The fourth side cover portion 85 includes a substantially flat perforated metal 85P. The perforated metal 85P has substantially the same structure as that of the perforated metals 81P, 82P, 83P. The cover 8 is provided with a first cover side surface 84S facing the proximal end upper frame 21, a second cover side surface 85S facing the distal end upper frame 22, and the locking claw 86 provided on the first cover side surface 84S.

Figure 8:
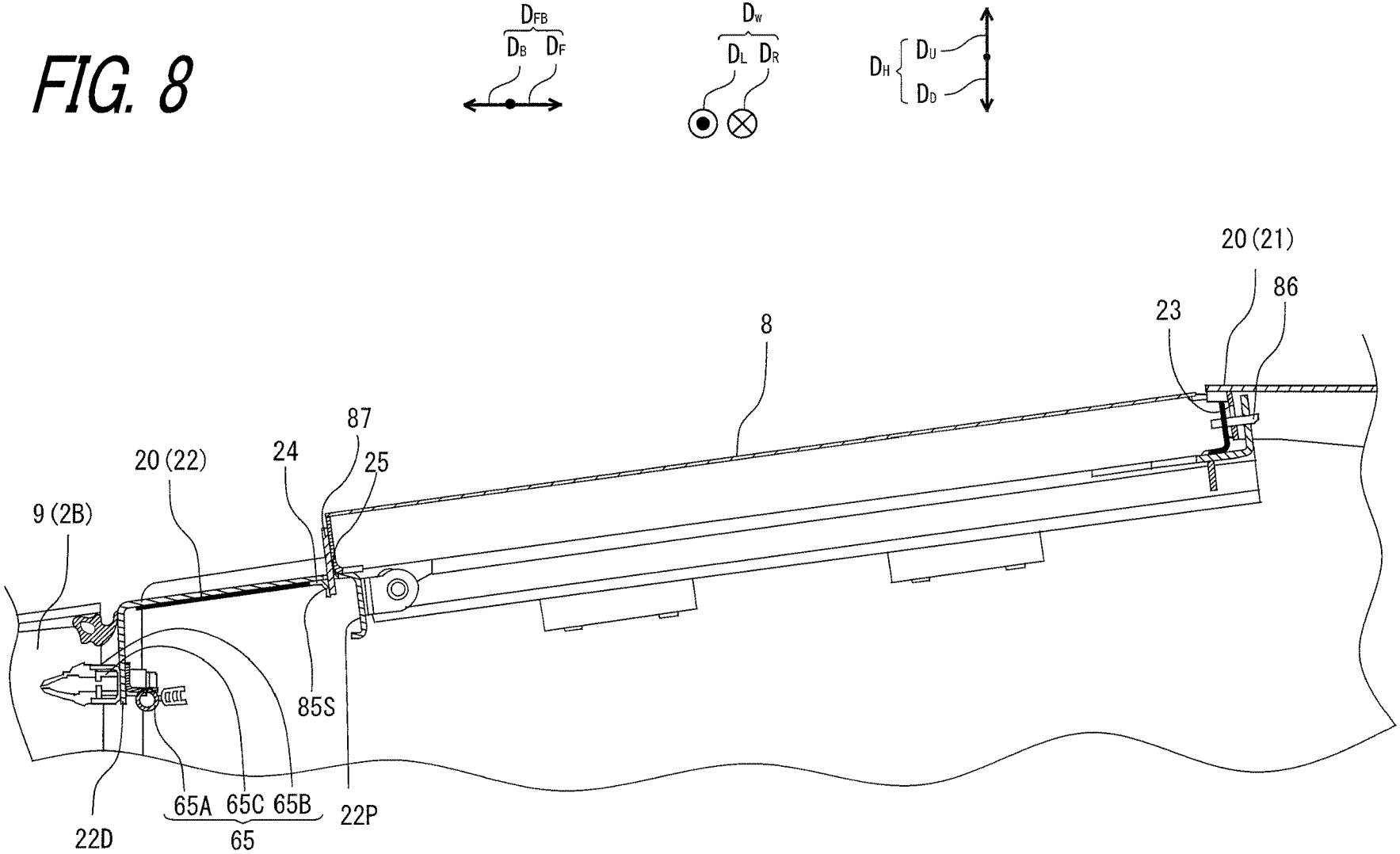
FIG. 8 is a cross-sectional view taken along cross-sectional lines VIII-VIII' of FIG. 6.
Figure 9:
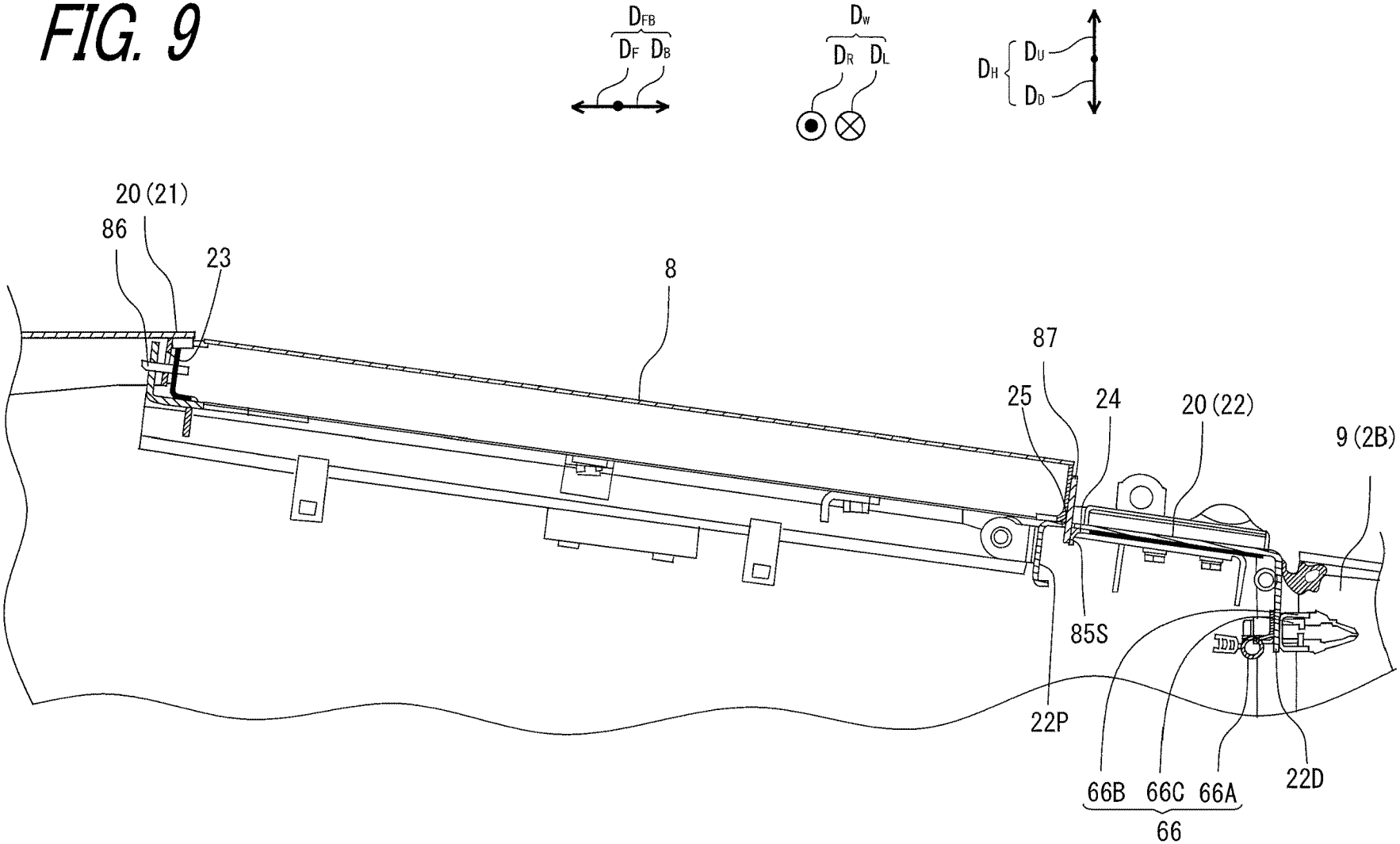
FIG. 9 is a sectional view taken along the cut line IX-IX' of FIG. 6.

FIG. 8 is a cross-sectional view taken along the cut line VIII-VIII' of FIG. 6. FIG. 9 is a sectional view taken along the cut line IX-IX' of FIG. 6. Although the cover 8 is omitted in FIG. 6, the cover 8 is displayed in FIGS. 8 and 9. Referring to FIGS. 6, 8 and 9, the proximal end upper frame 21 includes the insertion opening 23 penetrating in the front-rear direction $D_{FB}$. Referring to FIGS. 8 and 9, the locking claw 86 is configured to be inserted into the insertion opening 23.

Referring to FIGS. 6 and 7, the work vehicle 1 further includes a handle 26 provided on the distal end upper frame 22 to be rotatable about a rotational axis $A_{XH}$, and a handle hook 27 integrated with the handle 26 to be rotatable about the rotational axis $A_{XH}$. As shown in the enlarged view of the region B in FIG. 7, the work vehicle 1 further includes a detent 28 for the handle hook 27 provided on the distal end upper frame 22. Referring to FIGS. 4 and 5, the cover 8 further includes an engaging portion 88 capable of engaging with the handle hook 27 on the fourth side cover portion 85. The engaging portion 88 is a U-shaped rod-shaped member. In FIG. 7 and the enlarged view of region B of FIG. 7, the engaging portion 88 is indicated by a dotted line in order to show the relationship between the handle hook 27 and the engaging portion 88.

Figure 11:
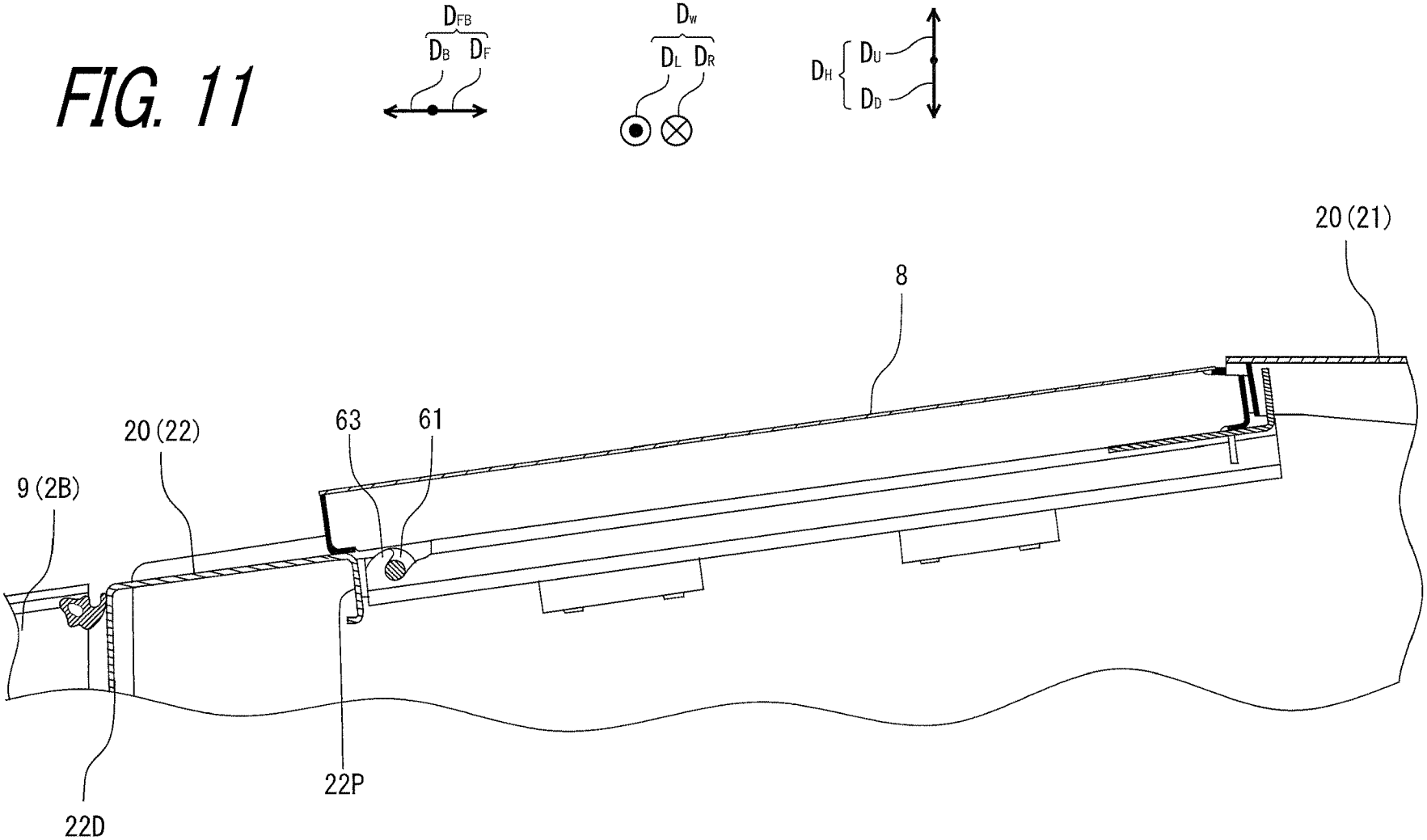
FIG. 11 is a cross-sectional view taken along the cross-sectional line XI-XI' of FIG. 10.
Figure 12:
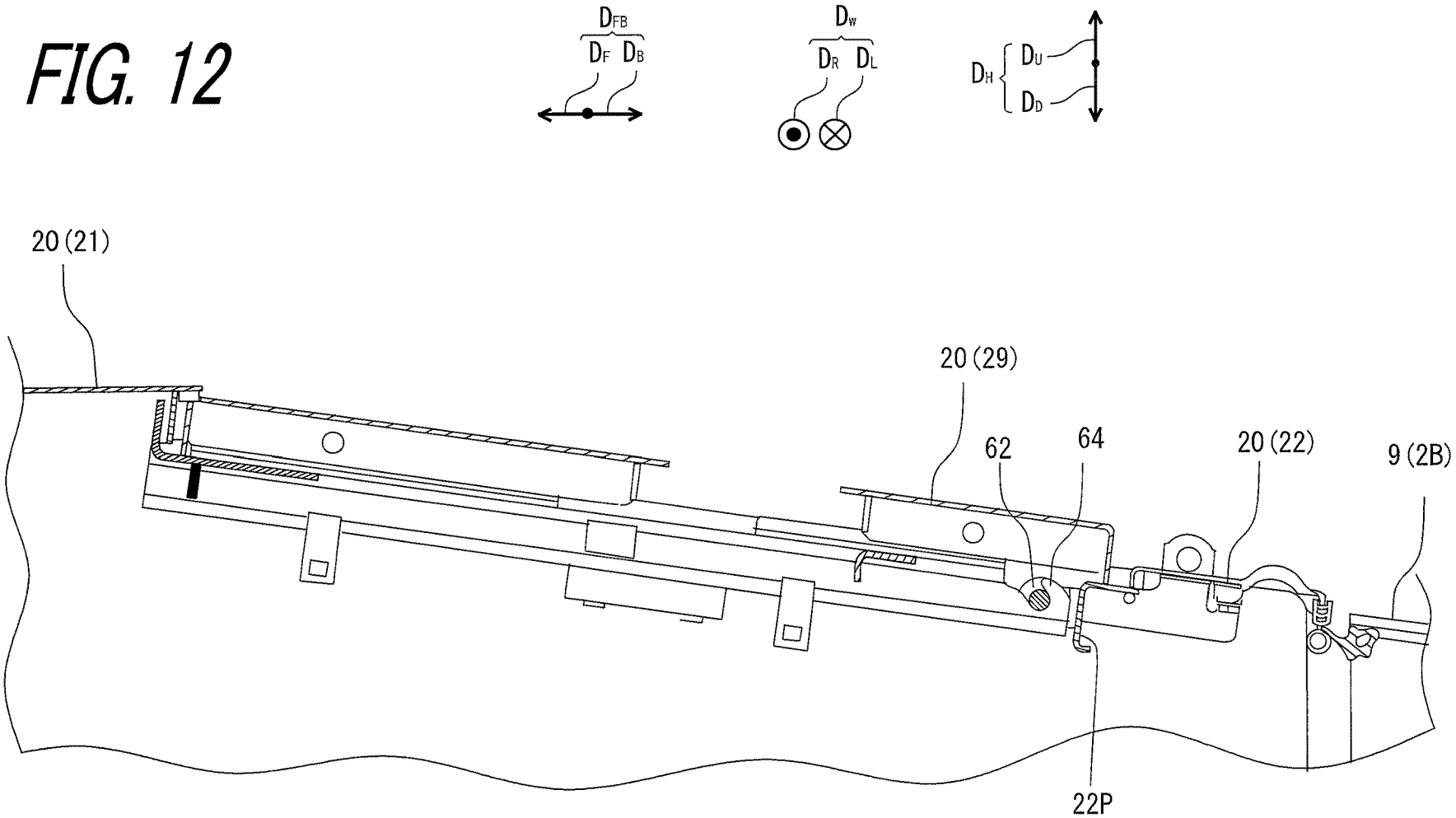
FIG. 12 is a cross-sectional view taken along cross-sectional line XII-XII' of FIG. 10.

As shown in FIG. 7, the work vehicle 1 further includes an additional cover 29 that closes the right adjacent to the opening 20*a*. The additional cover 29 can be removed independently after the cover 8 is removed. FIG. 10 is an enlarged view of the upper surface 20 of the rear portion of the work vehicle 1 when the cover 8 and the additional cover 29 are removed. FIG. 11 is a sectional view taken along the cut line XI-XI' of FIG. 10. Although the cover 8 and the additional cover 29 are omitted in FIG. 10, the cover 8 is displayed in FIG. 11. In FIG. 12, the additional cover 29 is shown. Referring to FIGS. 10-12, the distal end upper frame 22 includes a proximal end portion 22P facing the second cover side surface 85S and supporting the first and second engaging shafts 61 and 62, and a distal end portion 22D opposite the proximal end portion 22P in the front-rear direction $D_{FB}$.

The distal end upper frame 22 includes a first engaging shaft 61 and a second engaging shaft 62 at one end (base end portion 22P) in the front-rear direction $D_{FB}$. The work vehicle 1 is further provided with the first side surface hook 63 connected to the first side surface 2L and the second side surface hook 64 connected to the second side surface 2R. The first engaging shaft 61 is engageable with the first side surface hook 63. The second engaging shaft 62 is engageable with the second side surface hook 64. Referring to FIGS. 8 to 12, the distal end upper frame 22 supports the first engaging shaft 61 and the second engaging shaft 62 at the proximal end portion 22P in the front-rear direction $D_{FB}$.

Referring to FIGS. 8 and 9, the work vehicle 1 further includes at least one latch 65, 66 connected to at least one of the first side 2L and the second side 2R. At least one latch 65, 66 is configured to removably latch the other end (distal end portion 22D) of the distal end upper frame 22 opposite to one end (base end portion 22P) in the front-rear direction $D_{FB}$ of the distal end upper frame 22. That is, at least one of the latches 65 and 66 is configured to hold the distal end portion 22D. The latch 65 includes a first contact portion 65A and a second contact portion 65B facing each other in the front-rear direction $D_{FB}$, and a biasing member 65C that pulls the second contact portion 65B toward the first contact portion 65A. Each of the latches 66 is provided with a first contact section 66A and a second contact section 66B facing each other in the front-rear direction $D_{FB}$, and a biasing member 66C that pulls the second contact section 66B toward the first contact section 66A.

The distal end upper frame 22 can be separated from the first side surface 2L and the second side surface 2R by removing the other end (distal end portion 22D) from at least one of the latches 65, 66 and releasing the engagement of the first engaging shaft 61 with the first side surface hook 63 and the engagement of the second engaging shaft 62 with the second side surface hook 64. Here, the first side surface hook 63 and the second side surface hook 64 have an opening in a direction (front $D_F$) from the other end (distal end portion 22D) to one end (proximal end portion 22P) and in an upward direction $D_U$ in the height direction $D_H$. Therefore, it is easy to open the distal end upper frame 22 while rotating in the forward direction $D_F$ and upward direction $D_U$.

Operation and Effect of Embodiments

The cover 8 according to the present embodiment includes the center cover portion 81, the first side cover portion 82, and a second side cover portion 83. The center cover portion 81 includes a substantially flat perforated metal 81P. The center cover portion 81 has a substantially rectangular shape. The first side L1 and the second side L2 of the rectangle face each other in the width direction $D_W$, and the third side L3 and the fourth side L4 of the rectangle face each other in the front-rear direction $D_{FB}$. The first side cover portion 82 includes a substantially flat perforated metal 82P. The first side cover portion 82 has a substantially rectangular shape, which is connected to the center cover portion 81 at the first side L1, and is inclined downward $D_D$ in the height direction $D_H$ with respect to the center cover portion 81. The second side cover portion 83 includes a perforated metal 83P which is substantially flat. The second side cover portion 83 has a substantially rectangular shape, which is connected to the center cover portion 81 at the second side L2, and is inclined downward $D_D$ in the height direction $D_H$ relative to the center cover portion 81. Therefore, it is possible to provide the work vehicle 1 capable of securing high ventilation efficiency while securing visibility in the left and right sides. Furthermore, by storing the additional fan 72 in the empty space of the cover 8 having the shape of a truncated pyramid, the space can be effectively utilized. In addition, the perforated metals 81P, 82P, 83P are substantially flat, and the perforated metals 82P, 83P are inclined to the lower side $D_D$ in the height direction $D_H$ with respect to the perforated metal 81P, so that dust blocking the air suction port 8*a* hardly accumulates and can be easily blown away by the additional fan 72.

Further, the work vehicle 1 according to the present embodiment is provided with the proximal end upper frame 21 provided between the cabin 5 and the cover 8 in the front-rear direction $D_{FB}$, and the distal end upper frame 22 provided on the opposite side of the proximal end upper frame 21 with respect to the cover 8 in the front-rear direction $D_{FB}$. The proximal end upper frame 21 includes the insertion opening 23 which penetrates in the front-rear direction $D_{FB}$. The distal end upper frame 22 includes the pressing member (spring plate) 24 for pressing the cover 8 toward the proximal end upper frame 21. The cover 8 includes a first cover side surface 84S, a second cover side surface 85S, and the locking claw 86. The first cover side surface 84S faces the proximal end upper frame 21. The second cover side surface 85S faces the distal end upper frame 22 and is in contact with the pressing member 24. The locking claw 86 is provided on the first cover side surface 84S, and is configured to be inserted into the insertion opening 23. As a result, the cover 8 can be removed by hand without using tools.

Variations of the Embodiments

The cover 8 shown in the embodiment can also be applied to the work vehicle having an engine compartment in front of the cabin. In this case as well, it is preferable that the first side cover portion 82 and the second side cover portion 83 are inclined in the left direction $D_L$ or the right direction $D_R$. Further, at least one of the latches 65 and 66 shown in the embodiment may be any other component as long as it can hold the distal end portion 22D of the distal end upper frame 22.

As used herein, "comprising" and its derivatives are non-limiting terms that describe the presence of a component, and do not exclude the presence of other components not described. This also applies to "having", "including" and their derivatives.

The terms "member," "part," "element," "body," and "structure" may have multiple meanings, such as a single part or multiple parts.

Ordinal numbers such as "first" and "second" are simply terms used to identify configurations and do not have other meanings (e.g., a particular order). For example, the presence of the "first element" does not imply the presence of the "second element", and the presence of the "second element" does not imply the presence of the "first element".

Terms such as "substantially", "about", and "approximately" indicating degrees can mean reasonable deviations such that the final result is not significantly altered, unless otherwise stated in the embodiments. All numerical values described herein may be interpreted to include words such as "substantially," "about," and "approximately."

In the present application, the phrase "at least one of A and B" should be interpreted to include only A, only B, and both A and B.

In view of the above disclosure, it will be apparent that various changes and modifications of the present invention are possible. Therefore, the present invention may be carried out by a method different from the specific disclosure of the present application without departing from the spirit of the present invention.

What is claimed is:

1. A work vehicle comprising:

a cabin having a seat;

a vehicle body frame supporting the cabin and comprising:

a first side surface;

a second side surface opposite to the first side surface in a width direction; and a third side surface connecting the first side surface and the second side surface and facing the cabin in a front-rear direction perpendicular to the width direction; and a first traveling device provided on the first side surface of the vehicle body frame;

a second traveling device provided on the second side surface of the vehicle body frame;

a cover provided above the first side surface, the second side surface, and the third side surface in a height direction perpendicular to the width direction and the front-rear direction, air passing through the cover to and from a space surrounded by the first side surface, the second side surface, the third side surface, and the cabin, the cover comprising:

a center cover portion including a perforated metal and having a substantially rectangular shape, the substantially rectangular shape having a first side and a second side of the rectangle facing each other in the width direction and having a third side and a fourth side of the rectangle facing each other in the front-rear direction;

a first side cover portion including a perforated metal and having a substantially rectangular shape, the first side cover portion being connected to the center cover portion at the first side and being inclined downward in the height direction with respect to the center cover portion; and a second side cover portion including a perforated metal and having a substantially rectangular shape, the second side cover portion being connected to the center cover portion at the second side and being inclined downward in the height direction with respect to the center cover portion, wherein the cover further includes a stiffener that surrounds a periphery of the perforated metal of the center cover portion, a periphery of the perforated metal of the first side cover portion, and a periphery of the perforated metal of the second side cover portion and is thicker than the perforated metal.

2. A work vehicle comprising:

a cabin having a seat;

a vehicle body frame supporting the cabin and comprising:

a first side surface;

a second side surface opposite to the first side surface in a width direction; and a third side surface connecting the first side surface and the second side surface and facing the cabin in a front-rear direction perpendicular to the width direction; and a first traveling device provided on the first side surface of the vehicle body frame;

a second traveling device provided on the second side surface of the vehicle body frame;

a cover provided above the first side surface, the second side surface, and the third side surface in a height direction perpendicular to the width direction and the front-rear direction, air passing through the cover to and from a space surrounded by the first side surface, the second side surface, the third side surface, and the cabin, the cover comprising:

a center cover portion including a perforated metal and having a substantially rectangular shape, the substantially rectangular shape having a first side and a second side of the rectangle facing each other in the width direction and having a third side and a fourth side of the rectangle facing each other in the front-rear direction;

a first side cover portion including a perforated metal and having a substantially rectangular shape, the first side cover portion being connected to the center cover portion at the first side and being inclined downward in the height direction with respect to the center cover portion; and a second side cover portion including a perforated metal and having a substantially rectangular shape, the second side cover portion being connected to the center cover portion at the second side and being inclined downward in the height direction with respect to the center cover portion, wherein the vehicle body frame further includes an upper surface connected to an upper end of the first side surface, an upper end of the second side surface, and an upper end of the third side surface and having an opening, wherein the cover is provided so as to cover the opening, wherein the cover further includes a third side cover portion and a fourth side cover portion each having a trapezoidal shape connecting the center cover portion, the first side cover portion, the second side cover portion, and the upper surface and facing each other in the front-rear direction, wherein the third side cover portion is provided closer to the cabin than the fourth side cover portion in the front-rear direction, and wherein the fourth side cover portion includes a perforated metal.

3. The work vehicle according to claim 2, further comprising:

a heat exchanger provided to overlap with the opening when viewed from the height direction; and a fan provided below the heat exchanger in the height direction and configured to take outside air in from the cover and the opening.

4. The work vehicle according to claim 3, further comprising:

an additional fan provided between the cover and the heat exchanger in the height direction and configured to blow off dust accumulated on the perforated metal.

5. The work vehicle according to claim 2, wherein the upper surface comprises a proximal end upper frame provided between the cabin and the cover in the front-rear direction, and a distal end upper frame provided opposite to the proximal end upper frame with respect to the cover in the front-rear direction, wherein the proximal end upper frame includes an insertion opening penetrating the proximal end upper frame in the front-rear direction, wherein the distal end upper frame includes a pressing member to press the cover toward the proximal end upper frame, wherein the cover comprises a first cover side surface facing the proximal end upper frame, a second cover side surface facing the distal end upper frame and abutting against the pressing member, and a locking claw provided on the first cover side surface and configured to be inserted into the insertion opening.

6. A work vehicle comprising:

a cabin having a seat;

a vehicle body frame supporting the cabin and comprising:

a first side surface;

a second side surface facing the first side surface in a width direction;

a third side surface connecting the first side surface and the second side surface and facing the cabin in the front-rear direction perpendicular to the width direction; and an upper surface having an opening and connecting an upper end of the first side surface, an upper end of the second side surface, and an upper end of the third side surface;

a first traveling device provided on the first side surface of the vehicle body frame;

a second traveling device provided on the second side surface of the vehicle body frame; and a cover provided so as to cover the opening, air passing through the cover to and from a space surrounded by the first side surface, the second side surface, the third side surface, and the cabin, the upper surface comprising:

a proximal end upper frame provided between the cabin and the cover in a front-rear direction and having an insertion opening passing through the proximal end upper frame in the front-rear direction;

a distal end upper frame provided opposite to the proximal end upper frame with respect to the cover in the front-rear direction, the distal end upper frame comprising a spring plate to press the cover toward the proximal end upper frame, the cover comprising:

a first cover side surface facing the proximal end upper frame;

a second cover side surface facing the distal end upper frame to contact with the spring plate; and a locking claw provided on the first cover side surface and configured to be inserted into the insertion opening.

7. The work vehicle according to claim 5, wherein the cover is separatable from the vehicle body frame by releasing the contact between the second cover side surface and the pressing member and releasing engagement between the locking claw and the insertion opening.

8. The work vehicle according to claim 5, wherein the pressing member is formed of a spring plate.

9. The work vehicle according to claim 5, further comprising:

a handle provided on the distal end upper frame to be rotatable about a rotational axis; and a handle hook integrally formed with the handle to be rotatable about the rotational axis, the cover further comprising an engaging portion configured to engage the handle hook with the fourth side cover portion.

10. The work vehicle according to claim 5, further comprising:

a first side surface hook connected to the first side surface; and a second side surface hook connected to the second side surface, the distal end upper frame further comprising:

a first engagement shaft engageable with the first side surface hook; and a second engagement shaft engageable with the second side surface hook.

11. The work vehicle according to claim 10, further comprising at least one latch connected to at least one of the first side surface and the second side surface, the distal end upper frame including the first engagement shaft and the second engagement shaft at one end of the distal end upper frame in the front-rear direction, the at least one latch being configured to detachably latch another end of the distal end upper frame opposite to the one end in the front-rear direction.

12. The work vehicle according to claim 11, wherein the distal end upper frame is separatable from the first side surface and the second side surface by removing the another end from the at least one latch and releasing engagement between the first engagement shaft and the first side surface hook and engagement between the second engagement shaft and the second side surface hook.

13. The work vehicle according to claim 11, wherein the first side surface hook and the second side surface hook each have an opening opened in a direction from the another end to the one end and upward in the height direction.

14. The work vehicle according to claim 10, wherein the distal end upper frame includes a proximal end portion facing the second cover side surface and supporting the first engagement shaft and the second engagement shaft, and a distal end portion opposite to the proximal end portion in the front-rear direction, and wherein at least one latch is configured to grip the distal end portion.

15. The work vehicle according to claim 1, wherein the cover is provided behind the cabin in the front-rear direction.

16. The work vehicle according to claim 1, wherein the vehicle body frame further includes an upper surface connected to an upper end of the first side surface, an upper end of the second side surface, and an upper end of the third side surface and having an opening, wherein the cover is provided so as to cover the opening, wherein the cover further includes a third side cover portion and a fourth side cover portion each having a trapezoidal shape connecting the center cover portion, the first side cover portion, the second side cover portion, and the upper surface and facing each other in the front-rear direction, wherein the third side cover portion is provided closer to the cabin than the fourth side cover portion in the front-rear direction, and wherein the fourth side cover portion includes a perforated metal.

17. The work vehicle according to claim 16, further comprising:

a heat exchanger provided to overlap with the opening when viewed from the height direction; and a fan provided below the heat exchanger in the height direction and configured to take outside air in from the cover and the opening.

18. The work vehicle according to claim 17, further comprising:

an additional fan provided between the cover and the heat exchanger in the height direction and configured to blow off dust accumulated on the perforated metal.

19. The work vehicle according to claim 16, wherein the upper surface comprises a proximal end upper frame provided between the cabin and the cover in the front-rear direction, and a distal end upper frame provided opposite to the proximal end upper frame with respect to the cover in the front-rear direction, wherein the proximal end upper frame includes an insertion opening penetrating the proximal end upper frame in the front-rear direction, wherein the distal end upper frame includes a pressing member to press the cover toward the proximal end upper frame, wherein the cover comprises a first cover side surface facing the proximal end upper frame, a second cover side surface facing the distal end upper frame and abutting against the pressing member, and a locking claw provided on the first cover side surface and configured to be inserted into the insertion opening.

20. The work vehicle according to claim 19, wherein the cover is separatable from the vehicle body frame by releasing the contact between the second cover side surface and the pressing member and releasing engagement between the locking claw and the insertion opening.

* * * * *